US009840870B2

(12) United States Patent
Lu et al.

(10) Patent No.: US 9,840,870 B2
(45) Date of Patent: Dec. 12, 2017

(54) REEL PIPE MOTOR AND A ROLLING CURTAIN POSITIONING CONTROL SYSTEM

(71) Applicant: KRESTA HOLDINGS LIMITED, Malaga (AU)

(72) Inventors: Xianfeng Lu, Ningbo (CN); Jianguo Chen, Ningbo (CN); Mengxu Hu, Ningbo (CN)

(73) Assignee: NINGBO XIANFENG NEW MATERIAL CO., LTD., Ningbo (CN)

( * ) Notice: Subject to any disclaimer, the term of this patent is extended or adjusted under 35 U.S.C. 154(b) by 63 days.

(21) Appl. No.: 14/905,804

(22) PCT Filed: Oct. 27, 2015

(86) PCT No.: PCT/CN2015/092892
§ 371 (c)(1),
(2) Date: Jan. 16, 2016

(87) PCT Pub. No.: WO2016/197520
PCT Pub. Date: Dec. 15, 2016

(65) Prior Publication Data

US 2017/0183908 A1 Jun. 29, 2017

(30) Foreign Application Priority Data

Jun. 9, 2015 (CN) ..... 2015 1 0314151
Aug. 14, 2015 (CN) ..... 2015 2 0615588 U
Sep. 2, 2015 (CN) ..... 2015 1 0556049

(51) Int. Cl.
*A47G 5/02* (2006.01)
*A47H 1/00* (2006.01)
(Continued)

(52) U.S. Cl.
CPC ..... *E06B 9/72* (2013.01); *E06B 9/40* (2013.01); *E06B 9/42* (2013.01); *E06B 9/50* (2013.01); *E06B 2009/6845* (2013.01)

(58) Field of Classification Search
CPC ..... E06B 9/72; E06B 2009/725
(Continued)

(56) References Cited

U.S. PATENT DOCUMENTS 6,910,515 B2 * 6/2005 Nien ..... E06B 9/32 160/168.1 P
7,880,409 B2 * 2/2011 Miller ..... G03B 7/26 160/168.1 P
8,513,845 B2 * 8/2013 Angelini ..... E06B 9/72 160/310
(Continued)

FOREIGN PATENT DOCUMENTS

CN 201018345 Y 2/2008
CN 103628782 A 3/2014
(Continued)

*Primary Examiner* — Katherine Mitchell
*Assistant Examiner* — Jeremy Ramsey
(74) *Attorney, Agent, or Firm* — Heslin Rothenberg Farley & Mesiti P.C.; Victor A. Cardona, Esq.

(57) ABSTRACT

The present invention provides a reel pipe motor, comprising a casing; a motor and a speed reduction assembly disposed within the casing; an L-shape motor end head having a tubular part and a box part which could be connected with the casing, a switch box disposed on the outer surface of the box part, in which a switch control panel and a bead switch are located; and a power supply plug and a hollow rod. The bead switch is connected with the hollow rod. The bead switch could be operated by pulling the hollow rod. A first end of the power supply plug is electrically connected with the switch control panel, and a second end thereof extends into the hollow rod and is electrically connected with an external power supply. This invention further discloses a rolling curtain positioning control system comprising the said reel pipe motor.

15 Claims, 6 Drawing Sheets

(51) Int. Cl.

| | |
|---|---|
| ***E06B 9/72*** | (2006.01) |
| ***E06B 9/40*** | (2006.01) |
| ***E06B 9/50*** | (2006.01) |
| ***E06B 9/42*** | (2006.01) |
| *E06B 9/68* | (2006.01) |

(58) Field of Classification Search
USPC ..... 160/310, 311, 188, 168.1 P, 170, 171, 160/331
See application file for complete search history.

(56) References Cited

U.S. PATENT DOCUMENTS

| | | | | |
|---|---|---|---|---|
| 2009/0176615 | A1* | 7/2009 | Gasparrini | E06B 9/68 475/331 |
| 2010/0307701 | A1* | 12/2010 | Peterson | E06B 9/72 160/310 |
| 2011/0017411 | A1* | 1/2011 | Yeh | E06B 9/42 160/310 |
| 2011/0035908 | A1 | 2/2011 | Chen | |
| 2012/0053731 | A1* | 3/2012 | Feldstein | E06B 9/42 700/275 |
| 2013/0118695 | A1* | 5/2013 | Adams | E06B 9/72 160/310 |

FOREIGN PATENT DOCUMENTS

| | | | |
|---|---|---|---|
| CN | 204532011 | U | 8/2015 |
| CN | 104895478 | A | 9/2015 |
| CN | 104989259 | A | 10/2015 |
| EP | 0852281 | A2 | 7/1998 |

* cited by examiner

REEL PIPE MOTOR AND A ROLLING CURTAIN POSITIONING CONTROL SYSTEM

BACKGROUND OF THE INVENTION

Field of Invention

The present invention relates to the technical field of rolling curtain control, in particular, to a reel pipe motor and a rolling curtain positioning control system.

Related Art

The rolling curtain is usually manually driven or electrically driven in use. It is an important issue to precisely wind up a rolling curtain by electric drive in the normal use of an electric rolling curtain. In the conventional art, the upward and downward positioning of the rolling curtain is generally controlled by calculating the number of turns of the roller so that the electric rolling curtain can be precisely wound onto the reel pipe. The rolling curtain will move up or down for a fixed distance for each turn of the roller. The overall distance of upward or downward movement of the rolling curtain is equivalent to the number of turns of the roller multiplied by the upward or downward distance of the rolling curtain brought by each turn of the roller.

However, as the rolling curtain is usually flexible, under impacts of circumstantial factors, the number of turns of the flexible rolling curtain of a certain length wound on the roller would vary in such a manner that the rolling curtain is inaccurately positioned, which affects the use and appearance of the rolling curtain.

Moreover, the conventional electrically driven rolling curtain is generally driven by an electric reel pipe motor. Conventional reel pipe motors have to he turned on or off by turning on or off the general power supply, which makes for inconvenient use.

Furthermore, the conventional electric rolling curtain usually has to be powered on by an external power supply, meaning the rolling curtain could not normally be rolled down if the power is cut off.

SUMMARY OF THE INVENTION

In order to address the aforesaid defects, the present invention provides a reel pipe motor, the power supply of which could be conveniently turned on or off.

It is therefore an object of the present invention to provide a reel pipe motor, comprising a casing; a motor and a speed reduction assembly disposed within the casing; art L-shape motor end head having a tubular part and a box part which could be connected with the casing; a switch box disposed on the outer surface of the box part, in which a switch control panel and a bead switch are located; and a power supply plug and a hollow rod. The bead switch is connected with the hollow rod. The bead switch could be operated by pulling the hollow rod. A first end of the power supply plug is electrically connected with the switch control panel, and a second end thereof extends into the hollow rod and is electrically connected with an external power supply.

Moreover, a charge control circuit board as well as an external power line and a charging battery connected with the charge control circuit board are further provided within the casing. The external power line is electrically connected with the switch control panel after passing through the tubular part and the box part. The charge control circuit board is electrically connected with the motor. When the external power supply is turned on, the charging battery is charged by the external power supply when it drives the motor into operation, and when the external power supply is turned off, the motor is driven into operation by the rechargable battery.

Moreover, a power supply socket is further provided at the end of the hollow rod for inserting the external power supply.

Furthermore, a crown wheel and a clamp preventing the crown wheel from falling off the outer surface of the tubular part are covered on the outer surface of the tubular part.

In addition, the reel pipe motor further comprises a rotation wheel which is connected with the speed reduction assembly.

Further, the bead switch includes a main body electrically connected with the switch control panel and a bead chain extending into the main body. The hollow rod includes a conic contact and a hollow cylindrical tube connected with the conic contact. The bead chain extends into and is limited within the conic contact.

Moreover, a first via hole having a diameter smaller than that of the bead of the bead chain is formed on the top surface of the conic contact. A second via hole having a diameter larger than that of the bead of the bead chain is formed on the first side of the conic contact. The first via hole is in communication with the second via hole by a connecting seam.

Furthermore, a third via hole is formed on the second side of the conic contact, and a second end of the power supply plug extends into the hollow cylindrical tube through the third via hole.

In addition, the speed reduction assembly includes a worm connected with an output shaft of the motor and a plurality of cone pulleys and conic wheels engaged with each other. The rotation speed of the motor is transmitted to through the worm and reduced by the plurality of on pulleys, and then transmitted to the conic wheels.

Moreover, the plurality of cone pulleys includes first, second, third, fourth, and fifth cone pulleys, in which the year ratio of the worm to the first cone pulley is 15-20, the gear ratio of the first cone pulley to the second cone pulley is 2-5, the gear ratio of the second cone pulley to the third cone pulley is 10/(3-4), the gear ratio of the third cone pulley to the fourth cone pulley 350 is 2.5-3, the fourth cone pulley drives the filth cone pulley, the fifth cone pulley drives the conic wheel, and the gear ratio of the fifth cone pulley to the conic wheel is 800/(3-5).

Further, the first cone pulley is configured by a helical gear and a spur gear, the fifth cone pulley is configured by a bevel gear and a spur gear, and all the second, third and fourth cone pulleys are configured by two spur gears.

Moreover, a sensor is further provided at the switch control panel and when the sensor senses a target to be sensed, the circuit control panel turns on or off the power supply.

Furthermore, a level rod is further provided on the side of the box part.

The present invention further discloses a rolling curtain positioning control system, comprising the aforesaid reel pipe motor and curtain cloth. A starting end sensing element and a terminating end sensing element are respectively provided on two ends of the curtain cloth. When the curtain cloth is wound up, the reel pipe motor is stopped after the switch control panel senses the terminating end sensing element, and when the curtain cloth is wound down, the reel pipe motor is stopped after the switch control panel senses the starting end sensing element.

Furthermore, the starting end sensing element and the terminating end sensing element are both magnets, and a tongue tube is provided on the switch control panel.

The present invention has the following advantages over the prior art.

First, the external and internal power lines both hide within the casing, which provides an aesthetic appearance of the motor as a whole.

Second, the operation of the motor is controlled by the bead switch, which provides more convenient use. And the hollow rod could prevent the bead chain or rope winding onto the neck of children in use, preventing the potential risks.

Third, a charging battery is provided within the motor, in the normal power supply mode, the external power supply could be used to provide power to the motor and in the meantime charge the charging battery. And when the external power supply is cut off, power is provided by the charging battery to the motor.

Fourth, the starting end sensing element and the terminating end sensing element located on both ends of the curtain cloth, as well as the sense control configuration, guarantee the curtain cloth would not be affected by the winding looseness or tightness of the curtain cloth on the reel pipe while being wound down or up, which therefore provides a higher moving precision.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Embodiments of the present invention will be described in detail below with reference to the drawings. However, the present invention shall not be limited to these embodiments.

Figure 1:
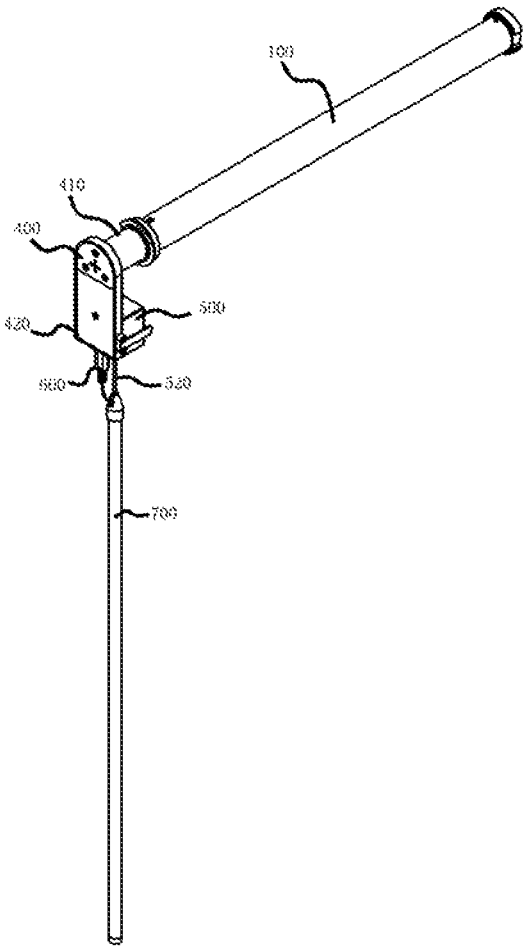
FIG. 1 is a stereogram of the reel pipe motor according to a preferred embodiment of the invention.
Figure 2:
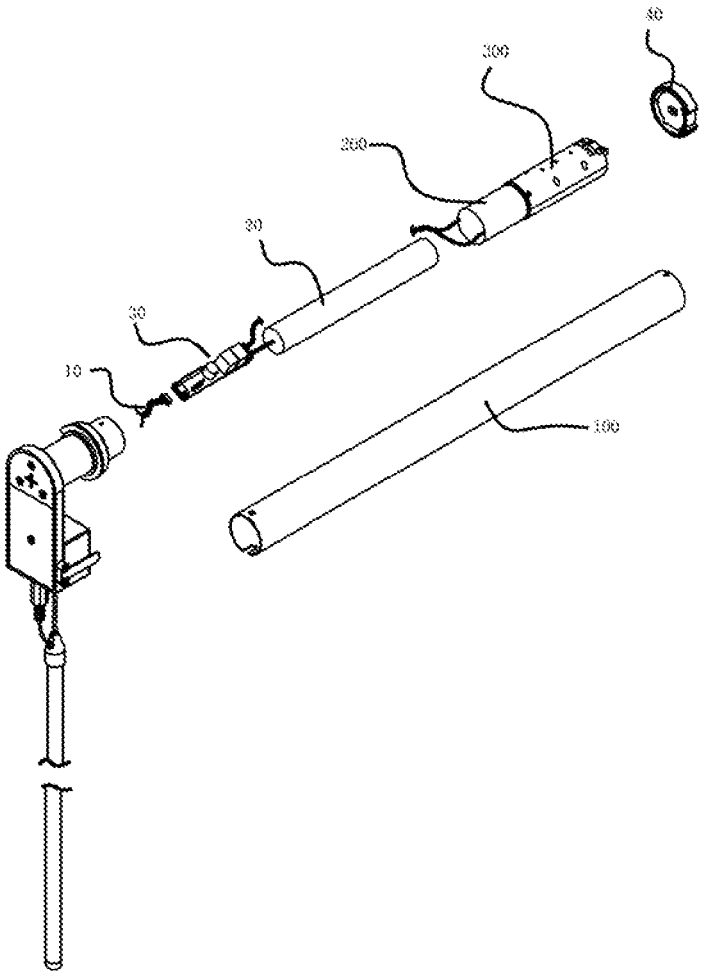
FIG. 2 is an exploded view of the reel pipe motor according to a preferred embodiment of the invention.
Figure 3:
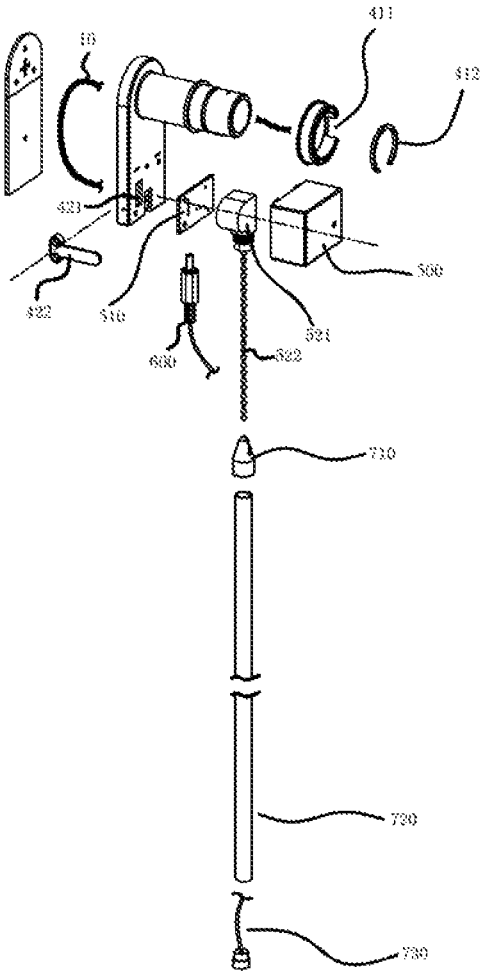
FIG. 3 is an exploded view of the motor end head according to a preferred embodiment of the invention.

With reference to FIGS. 1 and 2, the reel pipe motor of the invention comprises a casing 100; a motor 200 and a speed reduction assembly 300 disposed within the casing 100; an L-shape motor end head 400 having a tubular part 410 and a box part 420 which could be connected with the casing; a switch box 500 disposed on the outer surface of the box part, in which a switch control panel 510 and a bead switch 520 are located; a power supply plug 600 and a hollow rod 700. The bead switch 520 is connected with the hollow rod 700. The bead switch 520 could be operated by pulling the hollow rod 700. The first end of the power supply plug 600 is electrically connected with the switch control panel 510 and the second end thereof extends into the hollow rod 700 and is electrically connected with an external power supply.

The movement of the motor could be controlled by pulling the bead switch 520, so that the activation and disenablement of the reel pipe motor could be more simply controlled and more smoothly operated.

One end of the power supply plug 600 for connecting to the external power supply is inserted onto the switch control panel, and the wire connected with the other end thereof extends into the hollow rod and is then electrically connected with the external power supply. The external power line 10 electrically connected to the motor passes through the tubular part and box part of the motor end head and then is electrically connected with the switch control panel. A via hole 421 is located on the box part for passing the external power line 10. As the wire of the power supply plug 600 and the external power line 10 electrically connected to the motor respectively hide within the hollow rod and the motor end head, the reel pipe motor has a more aesthetic overall appearance.

Figure 4:
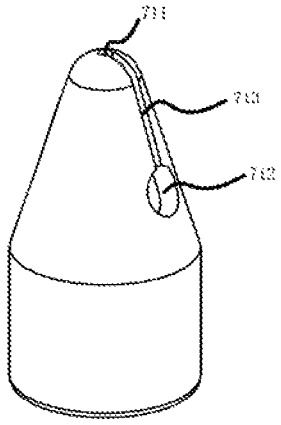
FIG. 4 is a stereogram of the conic contact according to a preferred embodiment of the invention.
Figure 5:
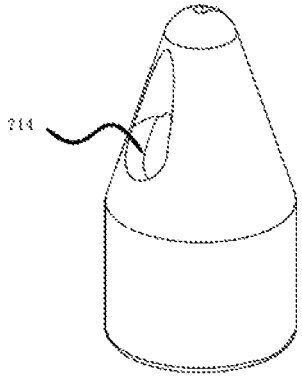
FIG. 5 is another stereogram of the conic contact according to a preferred embodiment of the invention.

Referring to FIGS. 4-5, in a preferred embodiment, the bead switch 520 is composed of a main body 512 electrically connected with the switch control panel and a bead chain 522. The hollow rod 700 is composed of a conic contact 710 and a hollow cylindrical tube 720 connected with the conic contact 710. A power supply socket 730 is inserted at the bottom of the hollow cylindrical tube 720 for inserting the external power supply.

A first via hole 711 having a diameter smaller than that of the bead of the bead chain, is formed on the top surface of the conic contact 710. A second via hole 717 having a diameter larger than that of the bead of the head chain is formed on the first side of the conic contact. The first via hole is in communication with the second via hole by the connecting seam 713. The bead at the end of the bead chain extends into the second via hole 712 and then moves to the lower end of the first via hole 711 along the connecting seam 713, thereby limiting the bead chain at the lower end of the first via hole 711.

A third via hole 714 is formed on the second side of the conic contact 710. The third via hole is substantially of a water-drop shape. The wire of the power supply plug extends into the hollow cylindrical tube through the third via hole 714.

Referring to FIG. 2, in this embodiment, not only the motor 200 and the speed reduction assembly 300 are located within the casing 100, but also the charging battery 20 and the charge control circuit board 30 are provided. The external power line 10, the charging battery 20 and the motor 200 are all electrically connected with the charge control circuit board 30. When the external power supply is transferred to the charge control circuit board 30 through the external power line 10, the charge control circuit board 30 transfers the external power supply to the charging battery and the motor respectively. When no external power supply is detected by the charge control circuit board, current is provided by the charging battery 20 to the motor 200.

A crown wheel 411 and a clamp 412 preventing the crown wheel 411 from falling off the outer surface of the tubular part are covered on the outer surface of the tubular part 410 of the motor end head.

A rotation wheel 40 is provided on the other end of the casing. The rotation wheel 40 is connected with the output end of the speed reduction assembly.

Figure 6:
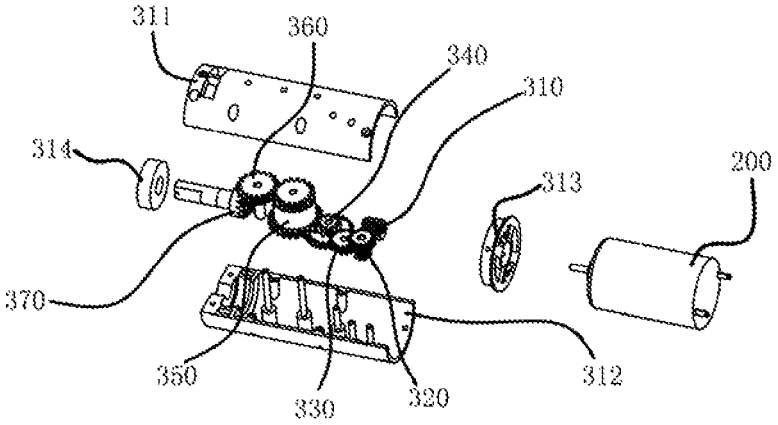
FIG. 6 is an exploded view of the speed reduction assembly according to a preferred embodiment of the invention.

As shown in FIG. 6, the speed reduction assembly 300 according to this embodiment comprises a worm 310 connected with the output shaft of the motor, a plurality of cone pulleys and conic wheels engaged with each other. The rotation speed of the motor is transmitted to through the worm and reduced by the plurality of cone pulleys, and then transmitted to the conic wheels.

In this embodiment, the first, second, third, fourth and fifth cone pulleys are provided, in which the gear ratio of the worm to the first cone pulley 320 is 15-20, the gear ratio of the first cone pulley 320 to the second cone pulley 330 is 2-5, the gear ratio of the second cone pulley 330 to the third cone pulley 340 is 10/(3-4), the gear ratio of the third cone pulley 340 to the fourth cone pulley 350 is 2.5-3, the fourth cone pulley 350 drives the fifth cone pulley 360, the fifth cone pulley 360 drives the conic wheel 370, and the gear ratio of the fifth cone pulley 360 to the conic wheel 370 is 800/(3-5).

The cone pulley configuration makes full use of the space of the reel pipe, which effectively shortens the length and reduces the volume.

The first cone pulley 320 is configured by a helical gear and a spur gear. The fifth cone pulley 360 is configured by a bevel gear and a spur gear. All the second, third and fourth cone pulleys are configured by two spur gears. The first and fifth cone pulleys are configured to cooperate with the worm and the conic wheel.

The speed reduction assembly further comprises a speed reduction gearbox upper casing 311, a speed reduction gearbox lower casing 312, a speed reduction gearbox cap 313 and a bearing 314. The speed reduction gearbox upper casing 311, the speed reduction gearbox lower casing 312, the speed reduction gearbox cap 313 and the bearing 314 are formed to receive the speed reduction configuration including the cone pulleys, wheels and worm.

Figure 7:
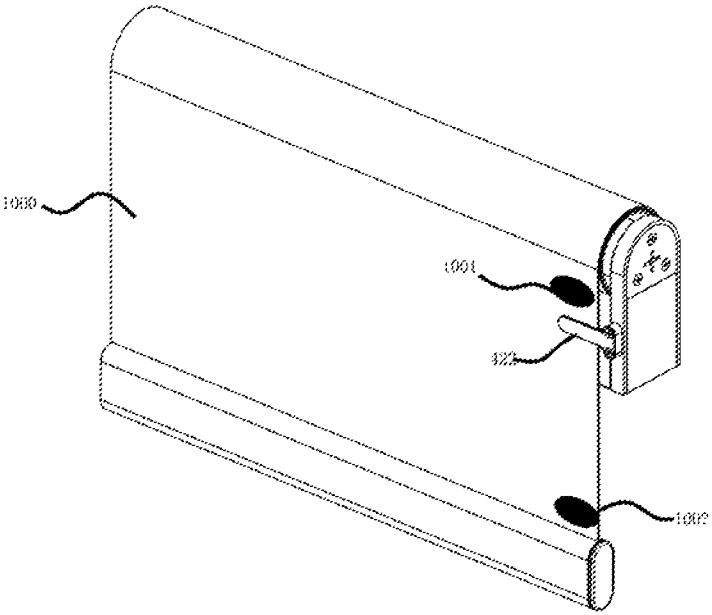
FIG. 7 is a stereogram of the rolling curtain positioning control system according to a preferred embodiment of the invention.

Referring to FIG. 7, the present invention further discloses a rolling curtain positioning system comprising the aforesaid reel pipe motor and curtain cloth 1000. The curtain cloth 1000 could be wound onto the reel pipe under the action of the reel pipe motor.

A starting end sensing element 1001 and a terminating end sensing element 1002 are respectively provided on two ends of the curtain cloth. A sensor not shown is disposed at the switch control panel within the switch box. When the curtain cloth is wound up, the reel pipe motor is stopped after the sensor senses the terminating end sensing element 1002. When the curtain cloth is wound down, the reel pipe motor is stopped after the sensor senses the starting end sensing element 1001.

When the curtain cloth is wound up, after the reel pipe motor is stopped following the sensor sensing the terminating end sensing element 1002, the reel pipe motor will not run even if the instruction to wind up the curtain cloth is executed again. By the same token, when the curtain cloth is wound down, after the reel pipe motor is stopped following the sensor sensing the starting end sensing element 1001, the reel pipe motor will not run even if the instruction to wind down the curtain cloth is executed again.

The sensor and sensing elements in this invention could employ infrared sensors or Holzer magnetic induction. In a preferred embodiment, the starting end sensing element 1001 and the terminating end sensing element 1002 are both magnets, and the sensor could include a tongue tube and the tongue tube could detect magnets and cut off circuit connection.

In order to reduce shake of the curtain cloth while being wound up and down, a level rod 422 is further provided on the side of the box part.

The specific embodiments described herein are merely illustrative of the spirit of the invention. It is apparent to those skilled in the art that various modifications, amendments and alternatives can be made to these embodiments without departing from the spirit or scope defined by the appended claims.

The invention claimed is:

1. A reel pipe motor, comprising:

a casing;

a motor and a speed reduction assembly disposed within the casing;

an L-shape motor end head having a tubular part and a box part connected with the casing;

a switch box disposed on an outer surface of the box part, said switch box having a switch control panel and a bead switch located therein; and a power supply plug and a hollow rod, wherein the bead switch is connected with the hollow rod, the bead switch is operated by pulling the hollow rod, a first end of the power supply plug is electrically connected with the switch control panel and a second end thereof extends into the hollow rod and is electrically connected with an external power supply.

2. The reel pipe motor as claimed in claim 1, wherein said casing comprises a charge control circuit board, an external power line and a charging battery connected with the charge control circuit board;

the external power line passes through the tubular part and the box part, the external power line is electrically connected with the switch control panel;

the charge control circuit board is electrically connected with the motor; and when the external power supply is turned on, the charging battery is charged by the external power supply when it drives the motor into operation, and when the external power supply is cut off, the motor is driven into operation by the charging battery.

3. The reel motor as claimed in claim 1, wherein a power supply socket for inserting the external power supply therein is located at the end of the hollow rod.

4. The reel pipe motor as claimed in claim 1, further comprising a crown wheel and a clamp located on the outer surface of the tubular part, the clamp preventing the crown wheel from falling off the outer surface of the tubular part.

5. The reel pipe motor as claimed in claim 1, further comprising a rotation wheel which is connected with the speed reduction assembly.

6. The reel pipe motor as claimed in claim 1, wherein the bead switch includes a main body electrically connected with the switch control panel and a bead chain extending into the main body; the hollow rod includes a conic contact and a hollow cylindrical tube connected with the conic contact; and the bead chain extends into and is limited within the conic contact.

7. The reel pipe motor as claimed in claim 6, wherein a first via hole having a diameter smaller than that of a bead of the bead chain, is formed on the top surface of the conic contact, a second via hole having a diameter larger than that of the bead of the bead chain is formed on the first side of the conic contact, and the first via hole is in communication with the second via hole by a connecting seam.

8. The reel pipe motor as claimed in claim 7, wherein a third via hole is formed on the second side of the conic contact, and a second end of the power supply plug extends into the hollow cylindrical tube through the third via hole.

9. The reel pipe motor as claimed in claim 1, wherein the speed reduction assembly includes:

a worm connected with an output shaft of the motor;

a plurality of cone pulleys and conic wheels engaged with each other; and a rotation speed of the motor transmitted through the worm, reduced by the plurality of cone pulleys, and then transmitted to the conic wheels.

10. The reel pipe motor as claimed in claim 9, wherein the plurality of cone pulleys includes first, second, third, fourth and fifth cone pulleys, in which the gear ratio of the worm to the first cone pulley has a range between 15 and 20 to 1, the gear ratio of the first cone pulley to the second cone pulley is has a range between 2 and 5 to 1 , the gear ratio of the second cone pulley to the third cone pulley has a range of 10 to between 3 and 4, the gear ratio of the third cone pulley to the fourth cone pulley has a range between 2.5 and 3 to 1, the fourth cone pulley drives the fifth cone pulley, the fifth cone pulley drives the conic wheel, and the gear ratio of the fifth cone pulley to the conic wheel has a range of 800 to between 3 and 5.

11. The reel pipe motor as claimed in claim 10, wherein the first cone pulley comprises a helical gear and a spur gear, the fifth cone pulley comprises a bevel gear and a spur gear, and each of the second, third and fourth cone pulleys comprise two spur gears.

12. The reel pipe motor as claimed in claim 1, wherein a sensor is further provided at the switch control panel and when the sensor senses a target, the circuit control panel turns on or off the power supply.

13. The reel pipe motor as claimed in claim 1, wherein a level rod is further provided on a side of the box part.

14. A rolling curtain positioning control system, comprising the reel pipe motor as claimed in claim 1, further comprising curtain cloth, in which a starting end sensing element and a terminating end sensing element are respectively provided on two ends of the curtain cloth, when the curtain cloth is wound up, the reel pipe motor is stopped after the switch control panel senses the terminating end sensing element, and when the curtain cloth is wound down, the reel pipe motor is stopped after the switch control panel senses the starting end sensing element.

15. The rolling curtain positioning control system as claimed in claim 14, wherein the starting end sensing element and the terminating end sensing element are both magnets, and a tongue tube is provided on the switch control panel.

* * * * *